US007191966B2

(12) United States Patent
Sawczyszyn

(10) Patent No.: US 7,191,966 B2
(45) Date of Patent: Mar. 20, 2007

(54) UNIVERSAL FLEXIBLE POWDER COATING TIP/NOZZLE

(76) Inventor: Jeffrey David Sawczyszyn, 3 Spruce St., Canisteo, NY (US) 14823

( * ) Notice: Subject to any disclaimer, the term of this patent is extended or adjusted under 35 U.S.C. 154(b) by 80 days.

(21) Appl. No.: 10/909,830

(22) Filed: Nov. 23, 2004

(65) Prior Publication Data

US 2005/0098667 A1 May 12, 2005

(51) Int. Cl.

| | |
|---|---|
| ***B05B 5/00*** | (2006.01) |
| ***B05B 5/025*** | (2006.01) |
| ***B05B 6/053*** | (2006.01) |
| ***H01R 4/60*** | (2006.01) |

(52) U.S. Cl. ..... 239/707; 239/706; 239/690; 239/588; 239/587.1; 439/194

(58) Field of Classification Search ..... 239/707, 239/706, 690, 588, 587.1, 690.1, 697, 698, 239/704, 525, 526; 118/621, 75; 439/194, 439/190, 191

See application file for complete search history.

(56) References Cited

U.S. PATENT DOCUMENTS

| | | | | |
|---|---|---|---|---|
| 3,698,636 | A * | 10/1972 | Szasz | 239/697 |
| 4,185,783 | A * | 1/1980 | Lacchia | 239/704 |
| 4,540,120 | A * | 9/1985 | Waszkiewicz | 239/1 |
| 4,547,029 | A * | 10/1985 | Kutnyak et al. | 439/194 |
| 4,660,772 | A * | 4/1987 | Rice | 239/704 |
| 2003/0001030 | A1 * | 1/2003 | Buscemi | 239/698 |

* cited by examiner

*Primary Examiner*—Kevin Shaver
*Assistant Examiner*—Darren Gorman

(57) ABSTRACT

This Universal Flexible Powder Coating Tip/Nozzle (7) will greatly enhance the application of Powder Coating coverage in hard to reach area's do to the ability to bend the flexible tip/nozzle (7) & (10) to reach into those difficult to reach area's. The Powder Coater will no longer have to try to angle a large cumbersome powder Coating gun (1) into tight corners and openings, he only needs to insert the Universal Flexible Powder Coating Tip/Nozzle (7) into these hard to reach areas and bend and turn for proper angle. The uncharged Powder will flow down the Flexible tip/nozzle and receive charging as it travels past the contact at the powder Tip (9) & (10).

1 Claim, 1 Drawing Sheet

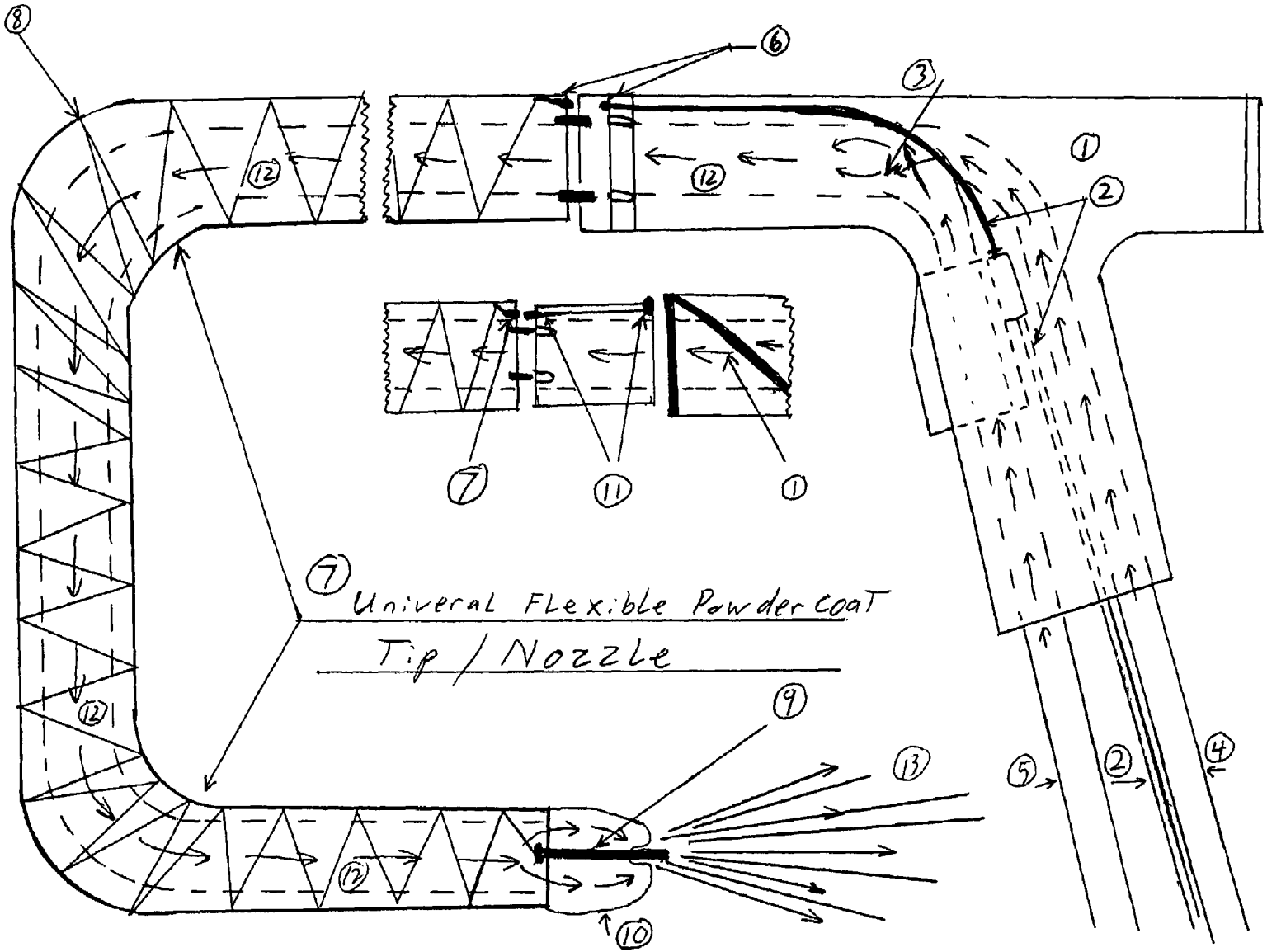
Universal Flexible Powder Coat
Tip / Nozzle

UNIVERSAL FLEXIBLE POWDER COATING TIP/NOZZLE

CROSS REFERENCE TO RELATED PATENTS

"Not Applicable"

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISK

"Not Applicable"

BACKGROUND OF THE INVENTION

1. Field of the Invention

This invention relates to the delivery of an air/powdered paint mixture, either Polyester or Epoxy in nature from the mixing chamber of an existing powder application gun, down a long Universal Flexible Powder Coating Tip/Nozzle hose that has a sprint type flexible conduit, inlaid into the non-stick hose material and running its full length. The air powder mixture is then electro statically charged as it exits the flexible powder coating Tip/nozzle by way of a charge, traveling from said existing powder coating gun through the flexible spring type conduit "which also acts as an hose reinforcement" to the charge electrode located in the air powder diffuser tip. The powder then exits the tip thus being charged as it passes the charge electrode were it will then be directed at the grounded material to be coated and the charged powder coat will then attach to said material. Due to the fact that this flexible powder coating tip/nozzle bends in any direction, a more complete and even coating can be obtained in hard to reach places.

2. Description of Related Art

"Not Applicable"

BRIEF SUMMARY OF THE INVENTION

This flexible Powder Coating Tip/Nozzle consists of a smooth flexible non-stick hose that has a spring running the full length inside, from the contact point on the existing powder coat gun to the contact charge electrode at the tip. The spring will be inlayed under a layer of non-stick material as to not promote powder build up inside the "Flexible Powder Coating Tip/Nozzle"

BRIEF DESCRIPTION OF THE SEVERAL VIEWS OF THE DRAWING(S)

The Drawing gives a basic outline of an Existing powder Coating Application Gun and a side view with cut away of the Flexible Powder coating Tip/Nozzle.

GENERAL DESCRIPTION OF DRAWING NUMERICAL REFERENCES

1) Typical Powder Coating Gun
2) Charge Feed Line
3) Air/Powder Mixing Chamber

4) Powder Feed Line
5) Air Supply Line
6) Charge Contact Points Between Gun and Universal Flexible Powder Coating Tip/Nozzle
7) Flexible Powder Coating Tip/Nozzle Non Stick Hose
8) Spring Type Flexible Conduit
9) Powder Tip Charging Electrode
10) Air Powder Diffuser Tip
11) Adapter for Multiple Style Guns
12) Directional Flow of Air Powder Mix
13) Charged Powder

DETAILED DESCRIPTION OF THE INVENTION

General

This specification pertains to a Provisional Patent application No. 60/492,270, Conf # 3498 and the Invention that I have made to enhance the application of Powder Coating in virtually all venues, and for virtually all applications especially hard to reach places that are extremely difficult to fit a powder coat gun. This invention will greatly enhance productivity and virtually eliminate recoating do to lack of coverage This flexible wand (7) is made out of a smooth flexible non-stick hose that has a spring (8) running the full length inside, from the contact point (6) on the existing powder coat gun (1) to the contact (charge electrode (9) at the tip). The spring will be inlayed under a layer of non-stick material as to not promote powder build up inside the "Flexible Powder Coating Tip/Nozzle"(7).

This flexible hose (7) and spring (8) are combined to give you maximized flexibility for getting to those hard to reach areas that are the most problematic when it comes to Powder Coating. Also as a result of the spring (8) running the full length of the hose, it provides reinforcement so that when the hose is bent it does not collapse and cause catastrophic results in your powdered components finish. * Note the spring (8) serves not only as the conductor between the gun (1) and the tip, but also as the reinforcement for the hose.

The flexible Powder Coating Tip/Nozzle (7) will be universal, in that through the use of adaptors (11) will fit almost any powder coating gun and or application currently in production. There will also be multiple length tips ranging from 12 to 24 to 36 inches long. Also there will be multiple diameters "Flexible Powder Coating Tips/Nozzles"(7), combined with multiple gun adaptors (11) will make this invention a universal fit for the Powder Coating Industry.

The invention claimed is:

1. A universal powder coating tip/nozzle for powder coating guns, comprising:

a) a smooth, elongated flexible non-stick hose having an interior surface and an exterior surface, an inlet disposed at one end of said hose and a powder application outlet tip disposed at an end opposite from said inlet, an entire length of said hose being defined between said inlet and said powder application outlet tip;

b) an adapter interposed between and in fluid communication with said hose inlet and a powder coating gun, said adapter permitting attachment of said hose to said gun;

c) an electrical contact point located at said hose inlet, said electrical contact point permitting electrical connection to an electrical contact point located on said adapter, wherein said adapter conducts electricity from said powder coating gun through said adapter and to said electrical contact point located at said hose inlet;

d) a powder charging electrode located at said powder application outlet tip of said hose; said powder charging electrode charging powder that exits said powder application outlet tip; and e) a spring having a first end proximate said hose inlet and a second end proximate said powder application outlet tip, said spring having a spiral arrangement and running said entire length of said hose and said spring being inlaid under a layer of non-stick material, said non-stick material defining said interior surface of said hose to thereby prevent powder build-up within said hose, said first end of said spring being electrically connected to said electrical contact point located at said hose inlet, and said second end of said spring being electrically connected to said powder charging electrode, wherein said spring conducts powder charging current from said adapter to said powder charging electrode, and wherein said spring also provides structural reinforcement for said hose.

* * * * *